US010578346B2

(12) United States Patent
Tarr et al.

(10) Patent No.: US 10,578,346 B2
(45) Date of Patent: Mar. 3, 2020

(54) STAND-ALONE ICE MAKING APPLIANCE

(71) Applicant: Haier US Appliance Solutions, Inc., Wilmington, DE (US)

(72) Inventors: Ronald Scott Tarr, Louisville, KY (US); Jarvis Ward, Louisville, KY (US); Tomas Garces, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 672 days.

(21) Appl. No.: 15/208,652

(22) Filed: Jul. 13, 2016

(65) Prior Publication Data

US 2018/0017305 A1 Jan. 18, 2018

(51) Int. Cl.

| | |
|---|---|
| ***F25D 23/00*** | (2006.01) |
| ***F25C 1/147*** | (2018.01) |
| ***F25C 5/182*** | (2018.01) |
| ***F25D 27/00*** | (2006.01) |
| ***F25D 25/02*** | (2006.01) |
| *F25D 21/14* | (2006.01) |

(52) U.S. Cl.

CPC ..... *F25C 1/147* (2013.01); *F25C 5/182* (2013.01); *F25D 25/025* (2013.01); *F25D 27/00* (2013.01); *F25C 2400/14* (2013.01); *F25D 21/14* (2013.01)

(58) Field of Classification Search

CPC ..... F25C 1/147; F25C 5/187; F25C 5/182; F25C 2400/14; F25C 2700/04; F25D 11/00; F25D 23/126; F25D 23/021; F25D 25/024; F25D 25/025; F25D 27/00; F25D 21/14; F25D 2323/122; F25D 23/067

USPC ..... 62/344

See application file for complete search history.

(56) References Cited

U.S. PATENT DOCUMENTS

| | | | | |
|---|---|---|---|---|
| 6,101,835 | A * | 8/2000 | Butsch | B67D 1/0864 222/146.1 |
| 8,033,133 | B2 | 10/2011 | Flores et al. | |
| 8,181,471 | B2 | 5/2012 | Heger et al. | |
| 9,441,873 | B1 * | 9/2016 | Drach | E06B 3/325 |
| 2004/0183415 | A1 * | 9/2004 | Kim | F25D 25/025 312/402 |
| 2016/0054042 | A1 * | 2/2016 | May | F25C 1/04 62/340 |
| 2017/0367478 | A1 * | 12/2017 | Ahmedov | A47B 57/58 |

* cited by examiner

*Primary Examiner* — Henry T Crenshaw
*Assistant Examiner* — Kamran Tavakoldavani
(74) *Attorney, Agent, or Firm* — Dority & Manning, P.A.

(57) ABSTRACT

A stand-alone ice making appliance is provided. The stand-alone ice making appliance may include an outer casing, a water tank, a pump, an ice maker, and a container. The outer casing may define an internal cavity that includes a primary opening. The water tank may define a storage volume to receive water. The pump may be in fluid communication with the storage volume of the water tank to actively flow water therefrom. The ice maker may in fluid communication with the storage volume of the water tank to receive water therefrom. The container may be disposed within the internal cavity. The container may include an insulated sidewall positioned across the primary opening and at least partially defining a storage volume to receive ice from the ice maker.

20 Claims, 8 Drawing Sheets

STAND-ALONE ICE MAKING APPLIANCE

FIELD OF THE INVENTION

The present subject matter relates generally to ice making appliances, and more particularly to ice making appliances that produce nugget ice.

BACKGROUND OF THE INVENTION

Ice makers generally produce ice for the use of consumers, such as in drinks being consumed, for cooling foods or drinks to be consumed and/or for other various purposes. Certain refrigerator appliances include ice makers for producing ice. The ice maker can be positioned within the appliance's freezer chamber and direct ice into an ice bucket where it can be stored within the freezer chamber. Such refrigerator appliances can also include a dispensing system for assisting a user with accessing ice produced by the refrigerator appliance's ice maker. However, the incorporation of ice makers into refrigerator appliances can have drawbacks, such as limits on the amount of ice that can be produced and the reliance on the refrigeration system of the refrigerator appliance to form the ice.

Recently, stand-alone ice makers have been developed. These ice makers are separate from refrigerator appliances and provide independent ice supplies. Generally, ice is provided into an interior volume. However, many stand-alone ice makers do not include an interior volume that is visible without opening the ice maker. Condensation and/or insulation may create difficulties in determining how much ice is contemporaneously available within the interior volume. Moreover, removing ice from the interior volume of many existing systems may be difficult. The area defining the interior volume may be provided as a removable bucket. Such systems may become increasingly heavy and/or difficult to remove if, for instance, a large amount of ice is held therein. If any ice within the interior volume has melted, it may be further difficult to remove the liquefied ice or water.

Accordingly, improved stand-alone ice makers are desired in the art. In particular, cost-effective stand-alone ice makers that address several of the above issues would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, a stand-alone ice making appliance is provided. The stand-alone ice making appliance may include an outer casing, a water tank, a pump, an ice maker, and a container. The outer casing may define an internal cavity that includes a primary opening through which the internal cavity may be accessed. The water tank may define a storage volume to receive water. The pump may be in fluid communication with the storage volume of the water tank to actively flow water therefrom. The ice maker may in fluid communication with the storage volume of the water tank to receive water therefrom. The container may be disposed within the internal cavity. The container may include an insulated sidewall positioned across the primary opening and at least partially defining a storage volume to receive ice from the ice maker. The sidewall may include a front panel and a rear panel that define a transparent insulation gap therebetween.

In another aspect of the present disclosure, a stand-alone ice making appliance is provided. The stand-alone ice making appliance may include an outer casing, a rail latch, a water tank, a pump, an ice maker, a container, and a guide rail. The outer casing may define an internal cavity. The rail latch may extend from the outer casing into the internal cavity along the lateral direction. The water tank may define a storage volume to receive water. The pump may be in fluid communication with the storage volume of the water tank to actively flow water therefrom. The ice maker may be in fluid communication with the storage volume of the water tank to receive water therefrom. The container may include a base wall and a sidewall that at least partially define a storage volume to receive ice from the ice maker. The container may be selectively positionable in a first position in which container is mounted within the internal cavity, a second position in which container extends outside of the internal cavity along the transverse direction, and a third position in which the container is tilted away from the internal cavity at a predetermined angle relative to the transverse direction. The guide rail may be fixed to the sidewall and extend therefrom in a lateral direction. The guide rail may define an inclined tilt catch to engage the rail latch when the container is in the third position.

In one aspect of the present disclosure, a stand-alone ice making appliance is provided. The stand-alone ice making appliance may include a water tank, a pump, an ice maker, a container, and a selective sealing system. The water tank may define a storage volume to receive water. The pump may be in fluid communication with the storage volume of the water tank to actively flow water therefrom. The ice maker may be in fluid communication with the storage volume of the water tank to receive water therefrom. The container may include a plurality of sidewalls and a base wall defining a storage volume to receive ice from the ice maker. The container may define at least one drain aperture extending through the container in fluid communication between the storage volume of the container and the storage volume of the water tank. The selective sealing system may include a plug paired to the drain aperture to selectively restrict fluid communication therethrough, and a spring attached to the plug and biased toward the drain aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
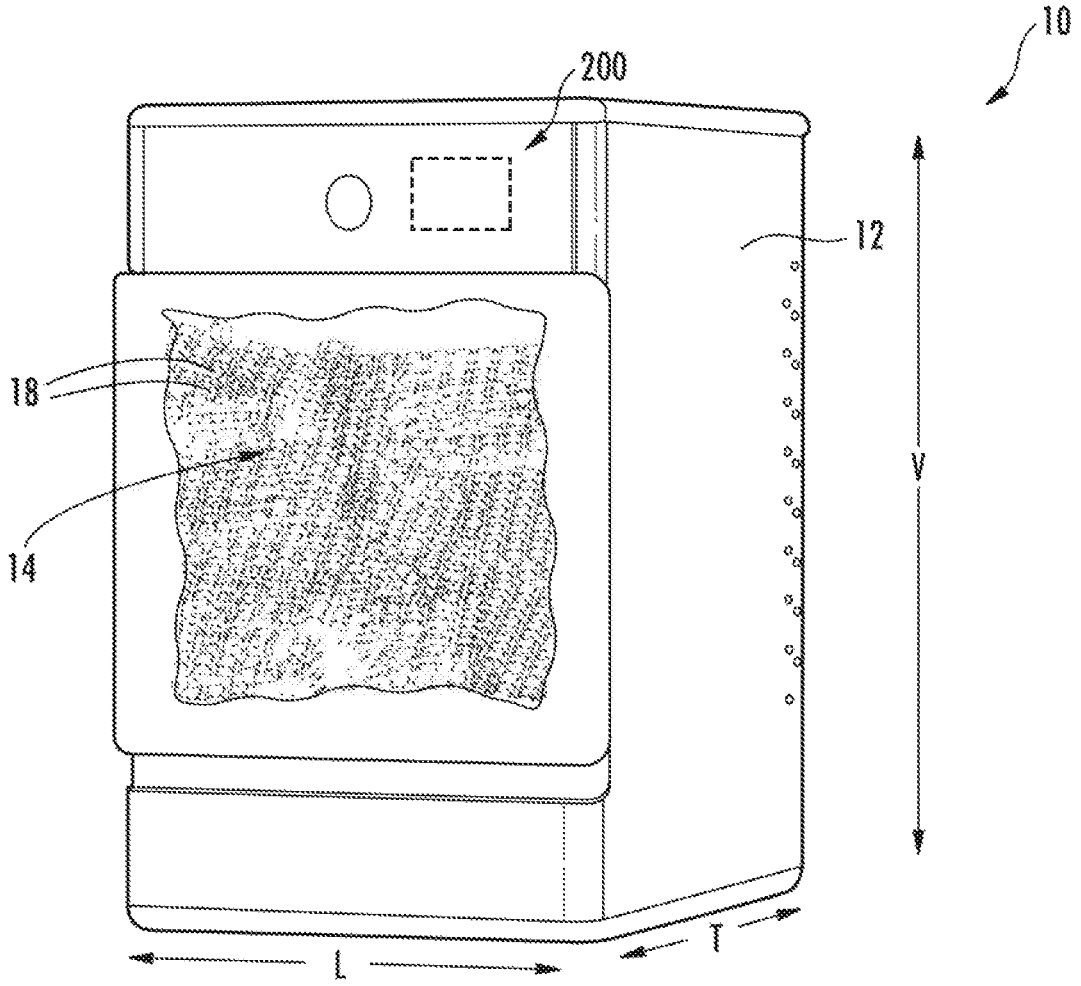
FIG. 1 provides a perspective view of an appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In some aspects of the present disclosure, an ice making appliance, including a container for storing ice, is provided. The container may include at least one transparent insulated wall. Additionally or alternatively, the container may be removable from a casing of the appliance. For instance, a user may be able to remove the container when ice is desired. The container may also be moved between various positions within the appliance. In one such position, the container may be tilted away from the appliance so that an internal volume of ice can be accessed by a user without requiring the user to otherwise support or remove the container. In certain aspects of the present disclosure, a plug is provided to selectively seal a drain port for liquids in a bottom portion of the container.

Figure 2:
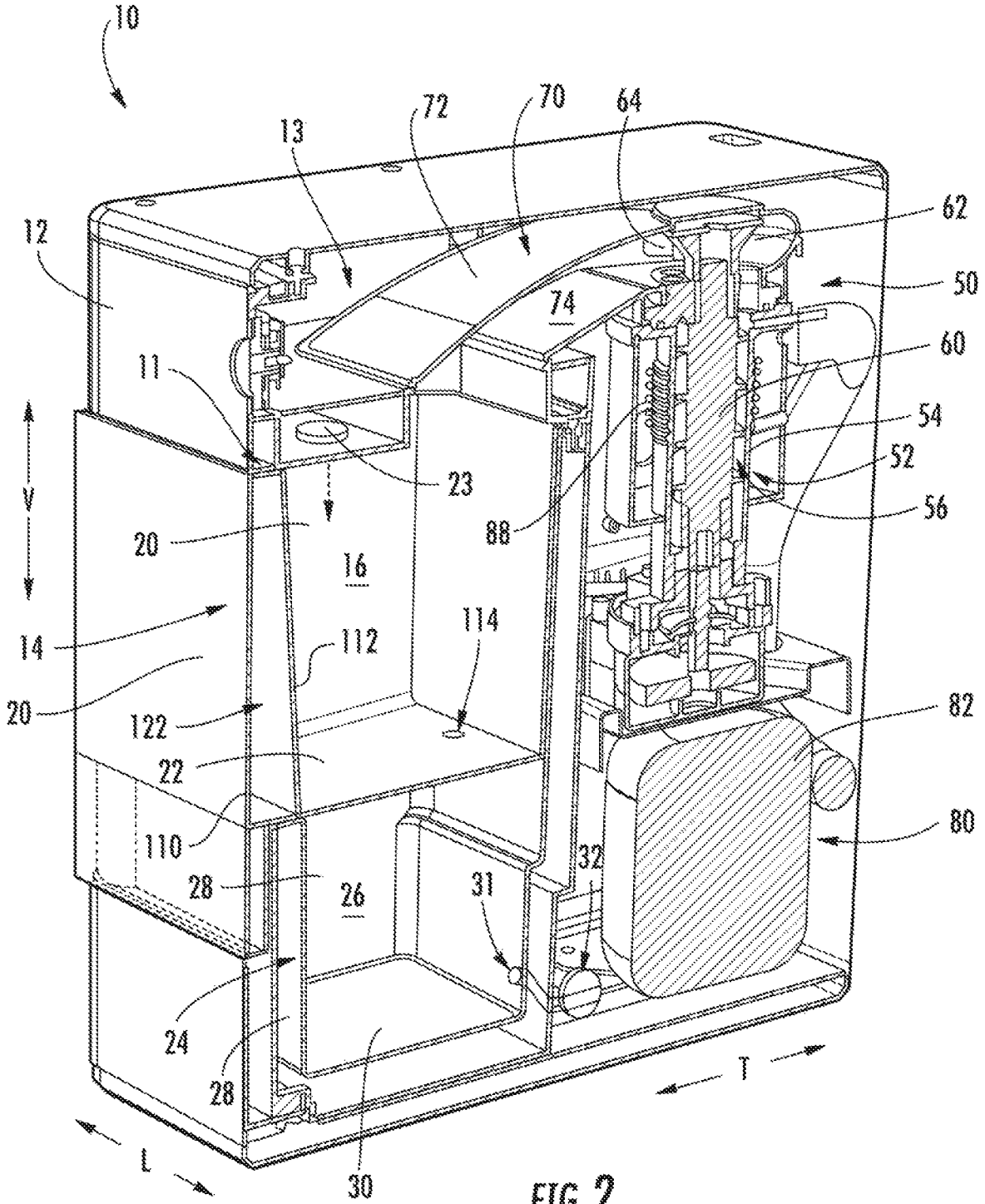
FIG. 2 provides a perspective sectional view of an appliance according to an exemplary embodiment of the present disclosure.
Figure 3:
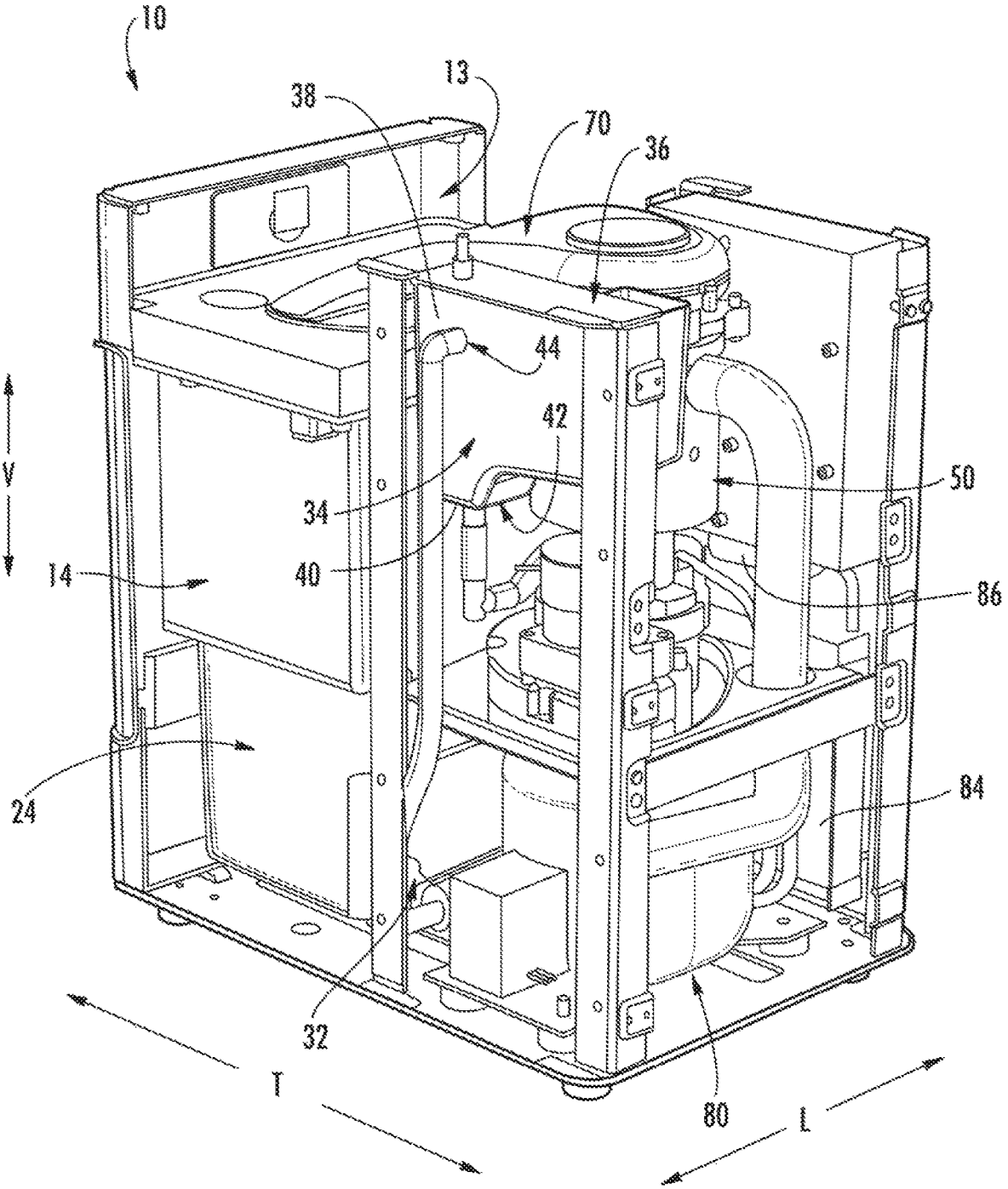
FIG. 3 provides a rear perspective view (with a casing removed) of an appliance according to an exemplary embodiment of the present disclosure.

Referring now to FIGS. 1 through 3, one embodiment of an appliance 10 in accordance with the present disclosure is illustrated. As shown, appliance 10 is provided as a stand-alone ice making appliance embodiment. Appliance 10 includes an outer casing 12 which defines a primary opening 11 and an internal cavity or volume 13. Internal volume 13 generally at least partially houses various other components of the appliance therein 10. Primary opening 11 defined in outer casing 12 may extend internal volume 13 to an ambient environment. Through primary opening 11, access (e.g., by a user) to the internal volume 13 may be permitted. Outer casing 12 further defines a vertical direction V, a lateral direction L, and a transverse direction T. The vertical direction V, lateral direction L, and transverse direction T are all mutually perpendicular and form an orthogonal direction system.

A container 14 of appliance 10 is also illustrated. Container 14 defines a first storage volume 16 for the receipt and storage of ice 18 therein. A user of the appliance 10 may access ice 18 within the container 14 for consumption or other uses, as described in detail below. Container 14 may include one or more sidewalls 20 and a base wall 22, which may together define the first storage volume 16. In exemplary embodiments, at least one sidewall 20 may be formed from a clear, see-through (i.e., transparent or translucent) material, such as a clear glass or plastic, such that a user can see into the first storage volume 16 and thus view ice 18 therein. For instance, at least one sidewall 20 may include a separate front panel 110 and rear panel 112 formed from a clear, see-through (i.e., transparent or translucent) material, such as a clear glass or plastic. Further, in exemplary embodiments, container 14 may be removable, such as from the outer casing 12, by a user. This facilitates easy access by the user to ice within the container 14 and further, for example, may provide access to a water tank 24 of the appliance 10, as will be discussed below.

In optional embodiments, a light source 23 is mounted within the internal volume 13. Generally, during operation, light source 23 may selectively emit or direct light into first storage volume 16, illuminating any ice 18 therein. Light source 23 may include a suitable light-emitting element, such as one or more fluorescent bulbs or light emitting diodes (LEDs). In exemplary embodiments, light source 23 is positioned above first storage volume 16, e.g., along the vertical direction V. Light source 23 may be mounted within casing 12 such that when container 14 is inserted within internal volume 13, light source 23 is positioned behind rear panel 112, e.g., along the transverse direction T.

Appliances 10 in accordance with the present disclosure are advantageously stand-alone appliances, and thus are not connected to refrigerators or other appliances. Additionally, in exemplary embodiments, such appliances are not connected to plumbing or another water source that is external to the appliance 10, such as a refrigerator water source. Rather, in exemplary embodiments, water is initially supplied to the appliance 10 manually by a user, such as by pouring water into water tank 24 and/or a reservoir.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. In exemplary embodiments, such as those shown in FIGS. 1 through 3, the removable container 14 allows easy access to ice 18 within first storage volume 16 and allows the container 14 to be moved to a different position from the remainder of the appliance 10 for ice usage purposes.

As discussed herein, appliance 10 is configured to make nugget ice (as discussed herein) which is becoming increasingly popular with consumers. Ice 18 may be nugget ice. Generally, nugget ice is ice that that is maintained or stored (i.e., in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Still referring to FIGS. 1 through 3, various components of appliances 10 in accordance with the present disclosure are illustrated. For example, as mentioned, appliance 10 includes a water tank 24. The water tank 24 defines a second storage volume 26 for the receipt and holding of water. Water tank 24 may include one or more sidewalls 28 and a base wall 30 which may together define the second storage volume 26. In exemplary embodiments, the water tank 24 may be disposed below the container 14 along the vertical direction V defined for the appliance 10, as shown.

As discussed, in exemplary embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through an opening 31 defined in the water tank 24, such as in a sidewall 28 thereof, and may flow through a conduit to and through pump 32. Pump 32 may, when activated, actively flow water from the second storage volume 26 therethrough and from the pump 32.

Water actively flowed from the pump 32 may be flowed (e.g., through a suitable conduit) to a reservoir 34. For example, reservoir 34 may define a third storage volume 36. In some embodiments, third storage volume 36 is defined by one or more sidewalls 38 and a base wall 40. Third storage volume 36 may, for example, be in fluid communication with the pump 32 and may thus receive water that is actively flowed from the water tank 24, such as through the pump 32. During operation, water may be flowed into the third storage volume 36 through an opening 42 defined in the reservoir 34.

Reservoir 34 and third storage volume 36 thereof may receive and contain water to be provided to an ice maker 50 for the production of ice. Accordingly, third storage volume 36 may be in fluid communication with ice maker 50. For example, water may be flowed, such as through an opening 44 and through suitable conduits, from third storage volume 36 to ice maker 50.

Ice maker 50 generally receives water, such as from reservoir 34, and freezes the water to form ice 18. In exemplary embodiments, ice maker 50 is a nugget ice maker, and in particular is an auger-style ice maker, although other suitable styles of ice makers and/or appliances are within the scope and spirit of the present disclosure. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening 58 may be defined in a sidewall 54. Water may be flowed from third storage volume 36 through the opening 58 (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in exemplary embodiments, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provide to the container 14. In exemplary embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72 which defines a passage 74 therethrough. Ice 18 may be directed from the ice maker 50 (such as from the auger 60 and/or extruder 62) through the passage 74 to the container 14. In some embodiments, for example, a sweep 64, which may be connected to and rotate with the auger, may contact the ice emerging through the extruder 62 from the auger 60 and direct the ice 18 through the passage 74 to the container 14.

As discussed, water within the casing 52 may at least partially freeze due to heat exchange, such as with a refrigeration system. In exemplary embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86, and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof.

During operation of sealed system 80, refrigerant exits evaporator 88 as a fluid in the form of a superheated vapor and/or vapor mixture. Upon exiting evaporator 88, the refrigerant enters compressor 82 wherein the pressure and temperature of the refrigerant are increased such that the refrigerant becomes a superheated vapor. The superheated vapor from compressor 82 enters condenser 84 wherein energy is transferred therefrom and condenses into a saturated liquid and/or liquid vapor mixture. This fluid exits condenser 84 and travels through throttling device 86 that is configured for regulating a flow rate of refrigerant therethrough. Upon exiting throttling device 86, the pressure and temperature of the refrigerant drop at which time the refrigerant enters evaporator 88 and the cycle repeats itself. In certain exemplary embodiments, throttling device 86 may be a capillary tube. Notably, in some embodiments, sealed system 80 may additionally include fans (not shown) for facilitating heat transfer to/from the condenser 84.

It should additionally be noted that, in exemplary embodiments, a controller 200 may be in operative communication with the sealed system 80, such as with the compressor 82 thereof, and may activate the sealed system 80 as desired or required for ice making purposes.

In exemplary embodiments, controller 200 may be in operative communication with the pump 32. Such operative communication may be via a wired or wireless connection, and may facilitate the transmittal and/or receipt of signals by the controller 200 and pump 32. Controller 200 may be configured to activate the pump 32 to actively flow water. For example, controller 200 may activate the pump 32 to actively flow water therethrough when, for example, reservoir 34 requires water. A suitable sensor(s), for example, may be provided in the third storage volume 36. The sensor(s) may be in operative communication with the controller 200 may be transmit signals to the controller 200 which indicate whether or not additional water is desired in the reservoir 34. When controller 200 receives a signal that water is desired, controller 200 may send a signal to pump 32 to activate pump 32.

Figure 4:
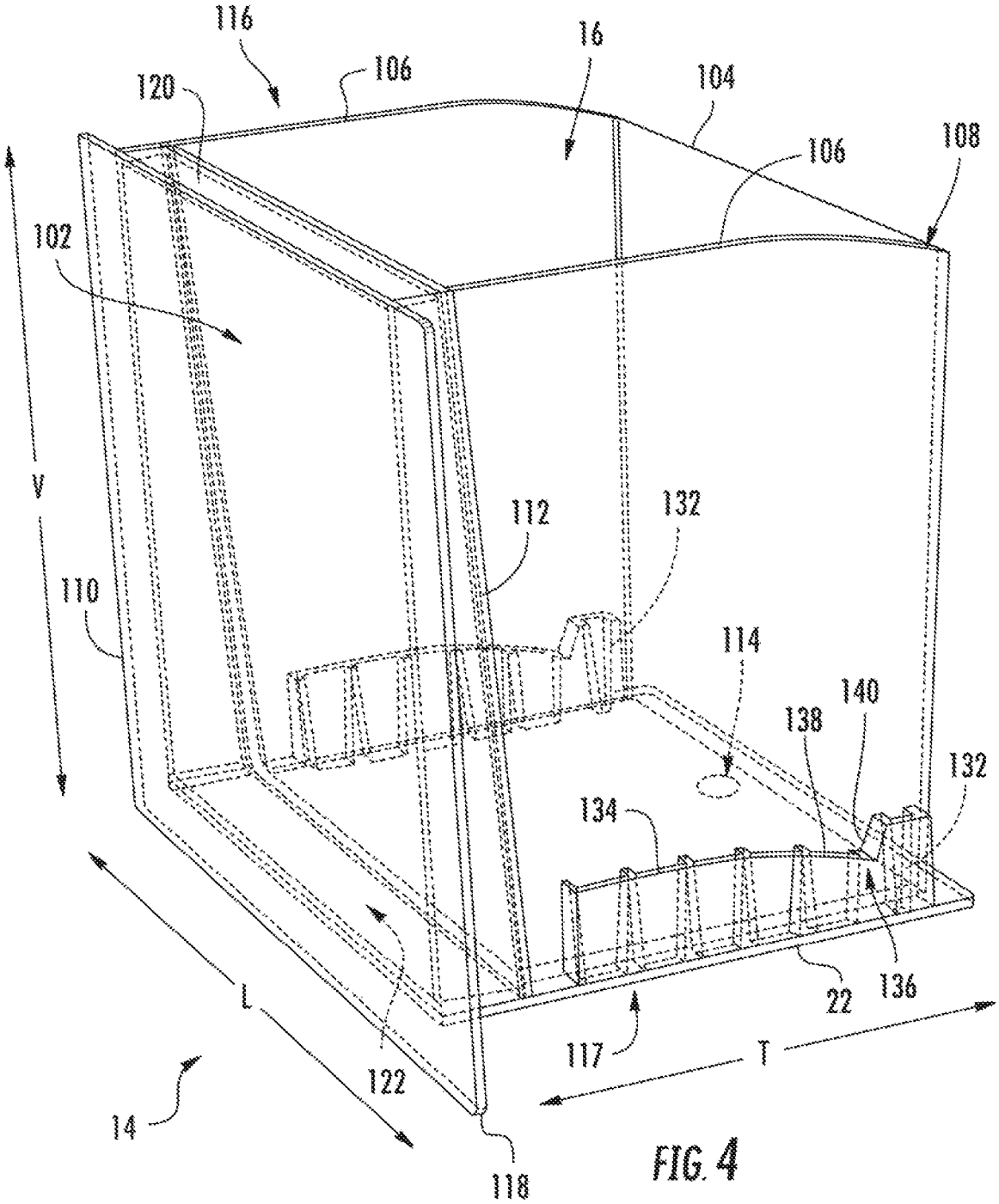
FIG. 4 provides a front perspective view of a container of an appliance, such as the exemplary appliance embodiment of FIG. 2.
Figure 5:
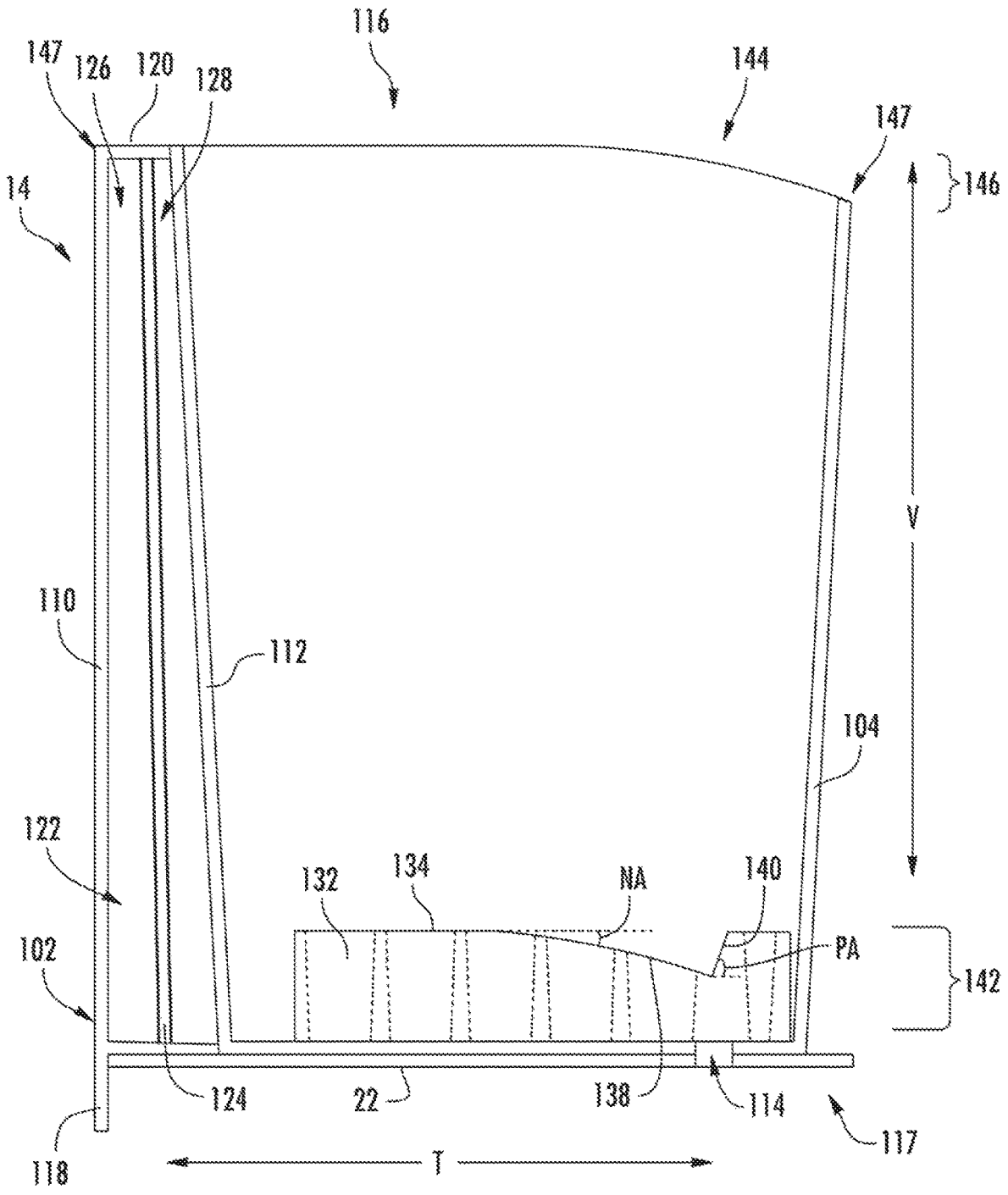
FIG. 5 provides a side view of a container of an appliance, such as the exemplary appliance embodiment of FIG. 2.
Figure 6:
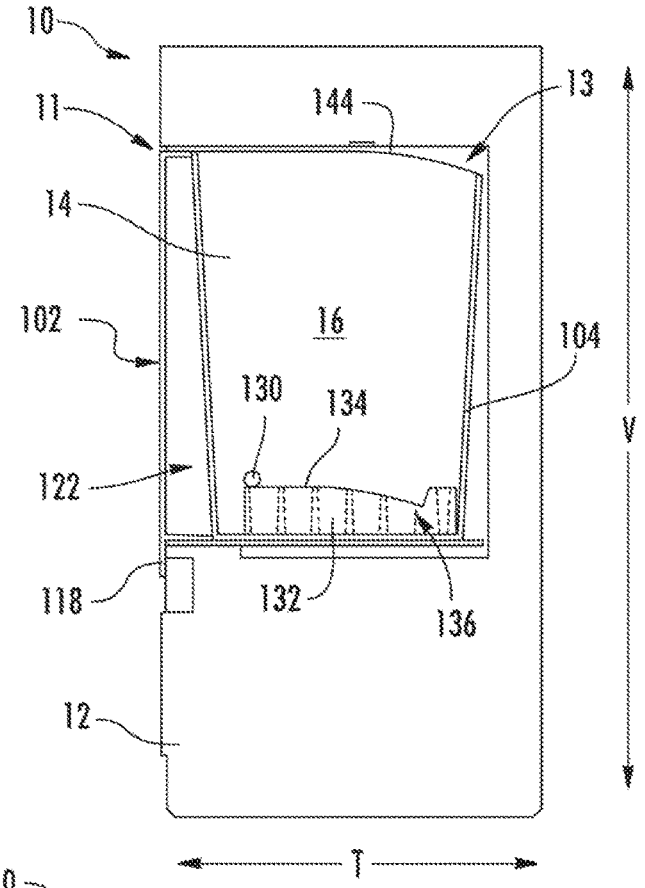
FIG. 6 provides a side plan view of the exemplary appliance embodiment of FIG. 2, with the container shown in a first position.

Turning to FIGS. 4 and 5, views of exemplary embodiments of container 14 are provided. It is understood that the indicated directions (i.e., the vertical direction V, lateral direction L, and transverse direction T) of FIGS. 4 and 5 are defined by container 14, but correspond to the same directions defined by casing 12 when container 14 is mounted within appliance 10, as is illustrated in FIG. 2. Nonetheless, it is also understood that the directions defined by container 14 are otherwise independent of those defined by appliance 10.

As described above, container 14 includes one or more sidewalls and a base wall 22 that define first storage volume 16. In some embodiments, a plurality of sidewalls is provided, including a front wall 102, a rear wall 104, and a pair of oppositely-disposed lateral walls 106. Generally, sidewalls 102, 104, 106 correspond to sidewalls 20 shown in FIG. 2. Front wall 102 may be positioned at a front end while rear wall 104 is positioned at a rear end of container 14. Lateral walls 106 may extend between front wall 102 and rear wall 104. Together, the sidewalls 102, 104, 106 define an opening perimeter 108 at a top portion 116 (e.g., vertical extreme) of container 14. As shown, opening perimeter 108 may permit access to first storage volume 16, e.g., to add or remove ice therein. In additional or alternative embodiments, a drain aperture 114 is defined at a bottom portion 117 (e.g., vertical extreme) of container 14. For instance, drain aperture 114 may be defined through base wall 22 above water tank 24 (see FIG. 2). Ice 18 (see FIG. 1) held within the first storage volume 16 may gradually melt. The melting speed is increased for nugget ice due to the increased maintenance/storage temperature. Drain aperture 114, may advantageously drain melt water away from first storage volume 16. Additionally, and advantageously, the melt water may in exemplary embodiments be reused by appliance 10 to form ice.

Exemplary embodiments of container 14 include at least one insulated sidewall, e.g., front wall 102. In some such embodiments, when container 14 is inserted into internal volume 13, insulated sidewall 102 is positioned across primary opening 11. As shown, insulated sidewall 102 includes a front panel 110 and a rear panel 112. Each of front panel 110 and rear panel 112 extend from base wall 22. In some such embodiments, base wall 22 is positioned below a portion of insulated sidewall 102 such that base wall 22 is beneath the rear panel 112 along the vertical direction V. Optionally, each of front panel 110 and rear panel 112) extend vertically from base wall 22 to a top portion 116 of container 14. Front panel 110 and rear panel 112 are spaced apart, e.g., in the transverse direction T at base wall 22. A bottom lip 118 may extend below the base wall 22 along the vertical direction V from front panel 110. A roof segment 120 may span the distance between front panel 110 and rear panel 112 at the top portion 116 of container 14, e.g., above a transparent insulation gap 122.

In some embodiments, a transparent insulation gap 122 is defined between front panel 110 and rear panel 112. For instance, transparent insulation gap 122 may be provided as a sealed volume. Sealed volume may generally prevent the passage of air or oxygen to or from transparent insulation gap 122. In exemplary embodiments, transparent insulation gap 122 is substantially evacuated as a vacuum. In alternative exemplary embodiments, transparent insulation gap 122 is filled with a set mass of a predetermined gas, such as nitrogen, oxygen, argon, or a suitable inert gas. In optional embodiments, an intermediate panel 124 is disposed within the transparent insulation gap 122. As illustrated in the exemplary embodiment of FIG. 5, intermediate panel 124 may generally extend along the vertical direction V between front panel 110 and rear panel 112. Additionally or alternatively, intermediate panel 124 may extend from base wall 22 to roof segment 120. Optionally, intermediate panel 124 may isolate or seal multiple discrete areas within the transparent insulation gap 122. For instance, a first isolated chamber 126 may be defined within the transparent insulation gap 122 between front panel 110 and intermediate panel 124, while a second isolated chamber 128 is defined between intermediate panel 124 and rear panel 112.

Returning to FIG. 2, as well as FIGS. 4 through 9, some embodiments of appliance 10 include one or more rail latches 130. As shown, a rail latch 130 extends from the outer casing 12 into internal volume 13, e.g., along the lateral direction L. Rail latch 130 is positioned to selectively engage a portion of container 14 and/or slide thereon. For instance, rail latch 130 may include a fixed pin. Additionally or alternatively, rail latch 130 may include a rotatable wheel or bearing that can rotate relative to outer casing 12. In some embodiments, container 14 includes a guide rail 132 that is fixed to and exterior side of a lateral wall 106 and extends thereon, e.g., in the transverse direction T. When container 14 is mounted within internal volume 13, guide rail 132 may be aligned below rail latch 130. Optionally, each lateral wall 106 may include a separate guide rail 132 that is disposed below a separate rail latch 130.

Each guide rail 132 may include multiple segments along the direction in which the container 14 may be removed, e.g., the transverse direction T. For instance, guide rail 132 may include a smooth or low-friction planar segment 134 that extends linearly along the transverse direction T. Planar segment 134 may be positioned in front of an inclined tilt catch 136. As shown, guide rail 132 has a continuous low incline ramp 138 and a high incline ramp 140 that define inclined tilt catch 136. For instance, together, low incline ramp 138 and high incline ramp 140 may define a gradient profile height 142, e.g., in the vertical direction V, that gradually decreases before it increases. In exemplary embodiments, low incline ramp 138 extends at negative angle NA relative to the transverse direction T. At a base of the inclined catch, high incline ramp 140 extends at a positive angle NA relative to the transverse direction T. Optionally, the absolute value of the positive angle PA may be greater than the negative angle NA.

In some embodiments, lateral walls 106 each define a sloped edge 144 at the top portion 116. As illustrated, sloped edge 144 extends with lateral wall 106 along the transverse direction T between front end 147 and rear end 148. Optionally, front end 147 may be positioned above rear end 148, e.g., in the vertical direction V. In some such embodiments, sloped edge 144 generally corresponds to inclined tilt catch 136, e.g., at low incline ramp 138. For instance, sloped edge 144 may include a gradient profile height 146 that decreases according to the gradient profile height 142 of inclined tilt catch 136. Optionally, the gradient profile height 146 of sloped edge 144 may solely decrease between front end 147 and rear end 148. Gradient profile height 146 may decrease along a pattern that generally matches the negative angle NA of the corresponding low incline ramp 138.

As illustrated in FIGS. 6 through 9, exemplary embodiments of container 14 are selectively moveable between various positions on or within appliance 10. For instance, container 14 may be selectively positionable in a distinct first position (see FIG. 6), second position (see FIG. 7), and third position (see FIG. 8). In the first position of FIG. 6, container 14 may be considered fully mounted within internal volume 13. Bottom lip 118 extends below base wall 22. Bottom lip 118 engages a portion of outer casing 12 and may restrict rearward movement in the transverse direction T. Planar segment 134 is positioned directly below rail latch 130 and may restrict vertical or angular movement of container 14. Base wall 22 may extend along a level plane, e.g., a plane that is parallel to transverse direction T and/or lateral direction L.

Figure 7:
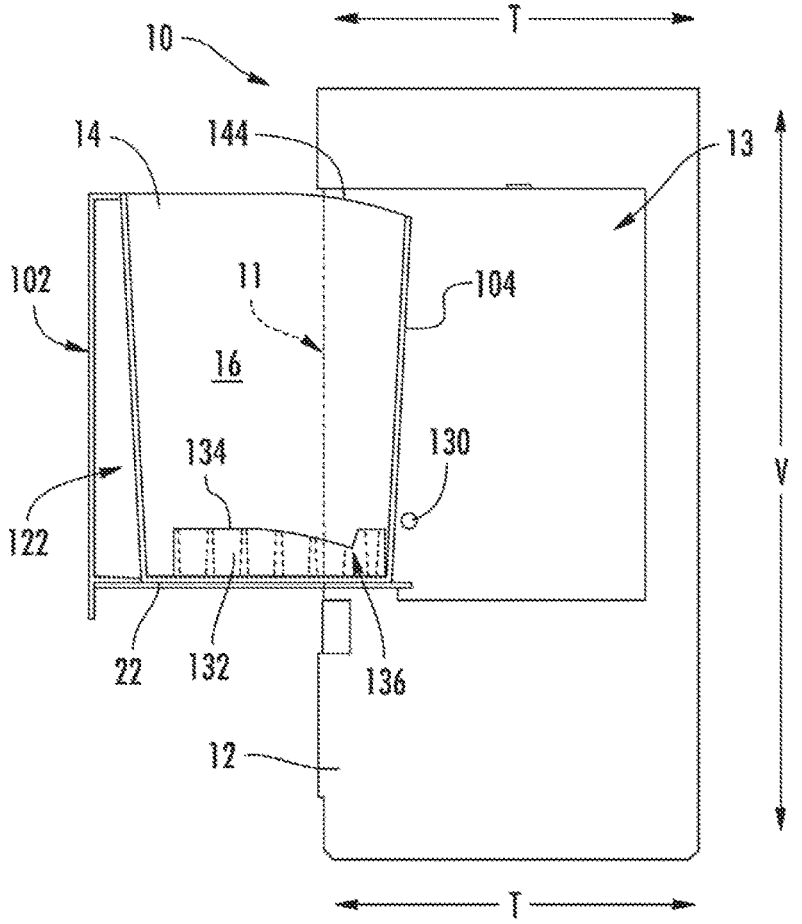
FIG. 7 provides a side plan view of the exemplary appliance embodiment of FIG. 2, with the container shown in a second position.

In the second position of FIG. 7, container 14 extends at least partially outside of the internal volume 13 and appliance 10. From the second position, container 14 may be removed from appliance 10, e.g., by forward manual linear movement of the container 14 in the transverse direction T away from internal volume 13. From the second position, container 14 may alternatively be inserted further into appliance 10, such as to the first position, e.g., by rearward manual linear movement of the container 14 in the transverse direction T toward internal volume 13. In exemplary embodiments, moving container 14 from the first position to the second position slides container 14 forward in the transverse direction T, e.g., away from internal volume 13. Moving container 14 from the second position to the first position slides container 14 rearward in the transverse direction T, e.g., toward internal volume 13. During forward and/or rearward movement, planar segment 134 slides below rail latch 130. Base wall 22 may remain along the same level plane as in the first position, e.g., a plane that is parallel to transverse direction T and/or lateral direction L.

Figure 8:
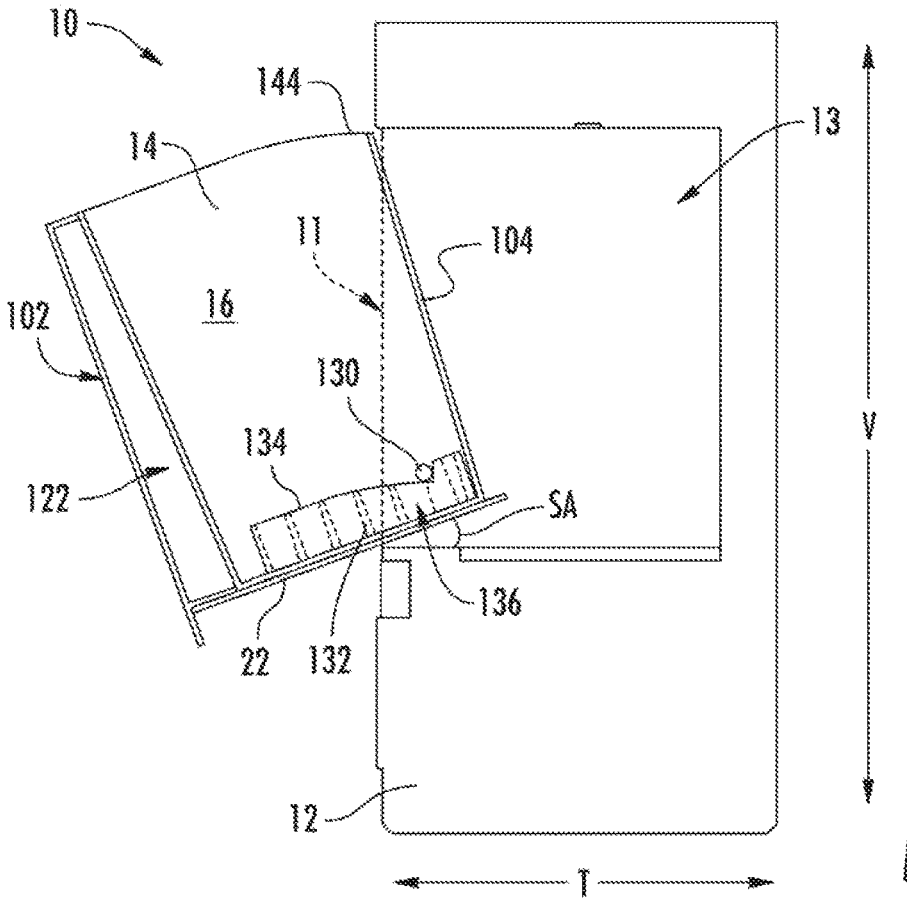
FIG. 8 provides a side plan view of the exemplary appliance embodiment of FIG. 2, with the container shown in a third position.
Figure 9:
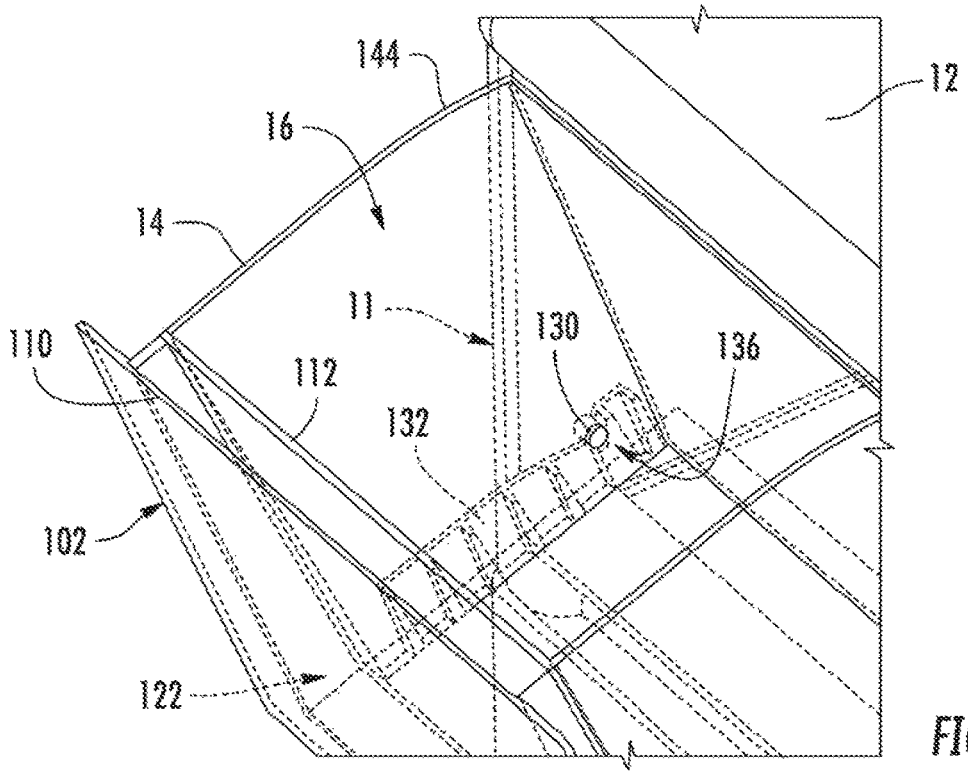
FIG. 9 provides a front perspective view of a portion of an appliance according to an exemplary embodiment of the present disclosure, with the container shown in a third position.

In the third position of FIG. 8, container 14 is tilted away from internal volume 13. The container 14 defines a predetermined angle SA relative to the transverse direction T, e.g., at base wall 22, that is distinct from any angle that container 14 defines in the first position. For instance, base wall 22 may extend along a new plane, e.g., a plane that is defined at predetermined angle SA and is not parallel to transverse direction T and/or lateral direction L. In the third position, inclined tilt catch 136 engages rail latch 130 (see also FIG. 9). Base wall 22 is balanced on a bottom edge of primary opening 11 while the mass of container 14 urges it forward. Moving from the second position to the third position may require rotating container 14 forward until inclined tilt catch 136 strikes rail latch 130 and is prevented from further rotation. Optionally, first storage volume 16 may be substantially open and unobstructed in the third position. Access of first storage volume 16, e.g., by a user, may thus be permitted. In some embodiments, sloped edge 144 avoids contact with outer casing 12 as container 14 moves to or from the third position.

Figure 10:
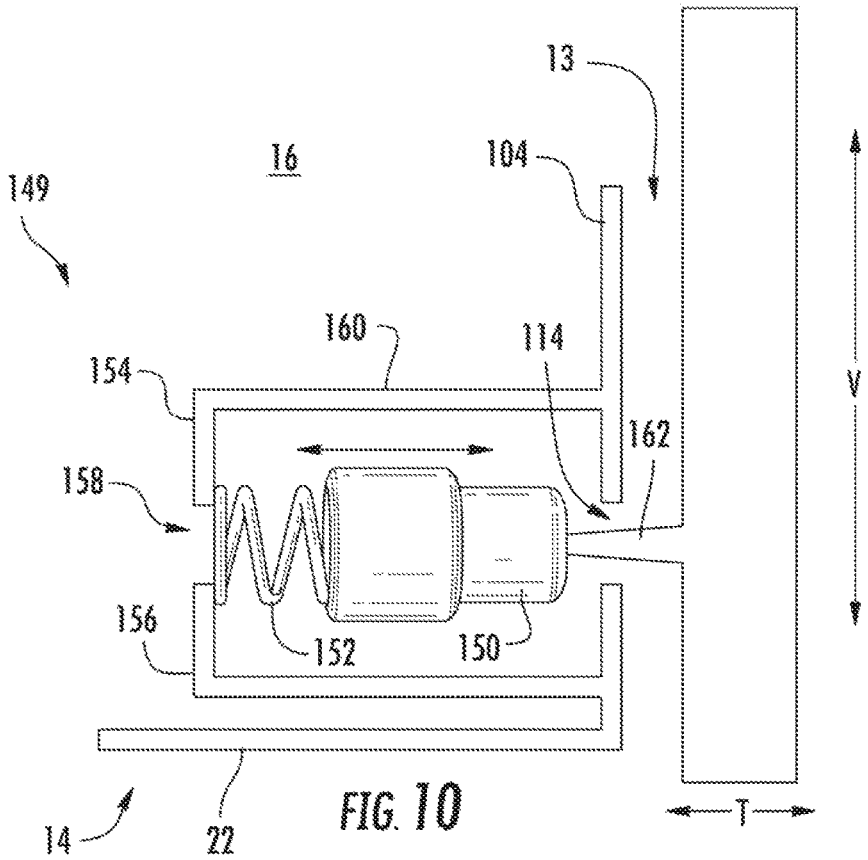
FIG. 10 provides a side plan view of a portion of a container including a plug for an appliance according to an exemplary embodiment of the present disclosure, wherein the plug is in an engaged position.
Figure 11:
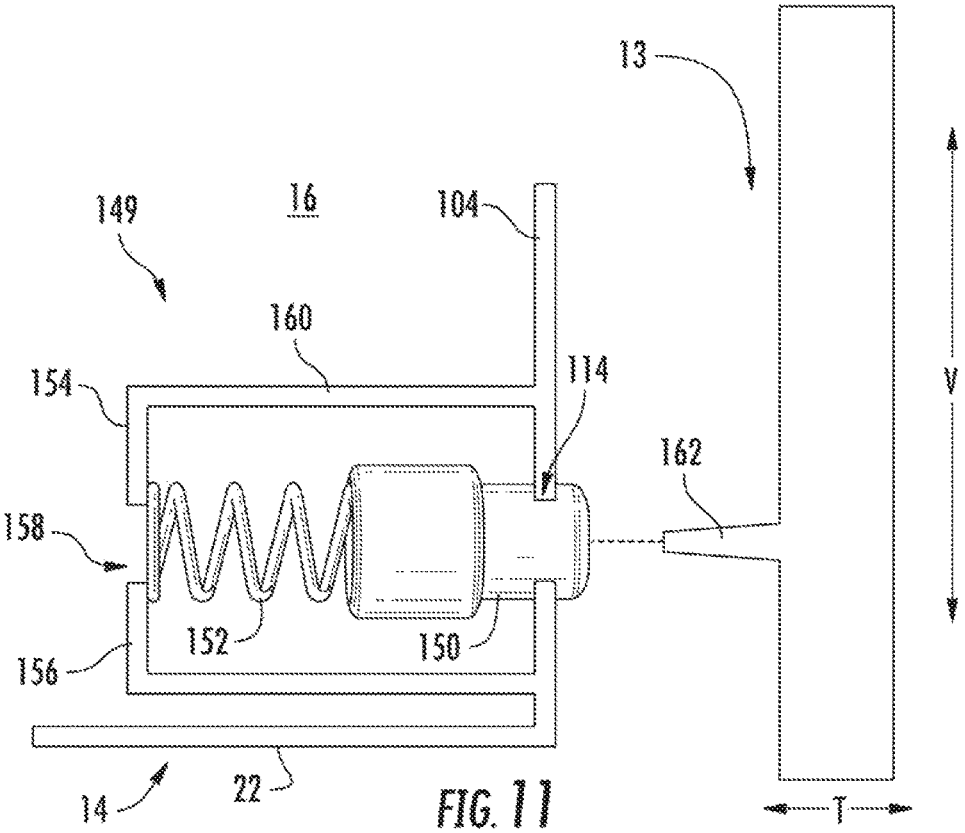
FIG. 11 provides a side plan view of a portion of a container including a plug for an appliance according to an exemplary embodiment of the present disclosure, wherein the plug is in a disengaged position.

Turning to FIGS. 10 and 11, some embodiments of container 14 may include a selective sealing system 149 to selectively permit or restrict water from exiting container 14. In exemplary embodiments, a resilient plug 150 is paired to drain aperture 114. As described, drain aperture 114 is defined through a portion of container 14, e.g., rear wall 104. Generally, sealing system 149 selectively fills or blocks drain aperture 114 according to a condition of container 14. For instance, in a fully mounted condition, plug 150 may be positioned away from drain aperture 114, as illustrated in FIG. 10. Water may be permitted to freely pass through drain aperture 114. In a non-fully mounted condition, plug 150 may extend to or through drain aperture 114, directly engaging a portion of container 14, as illustrated in FIG. 11. Water may be substantially prevented or restricted from passing through drain aperture 114.

A spring 152 may be attached to plug 150 in biased engagement. Spring 152 may generally urge plug 150 toward drain aperture 114. For instance, spring 152 may be embodied as a compression spring. Spring 152 may be positioned between a support tab 156 and plug 150. In some such embodiments, support tab 156 is fixed within first storage volume 16 of container 14. Optionally, support tab 156 may define a secondary aperture 158. For instance, secondary aperture 158 may be defined through support tab 156, radially inward (e.g., coaxial) with spring 152. Optionally, support tab 156 may be included as part of a plug enclosure 154. Any water exiting drain aperture 114 may be required to first pass through plug enclosure 154. Further included with plug enclosure 154 may be one or more guidewalls 160. Guidewalls 160 may direct movement of plug 150 and spring 152, e.g., along the transverse direction T. In some embodiments, guidewalls 160 extend from a sidewall of container 14, e.g., rear wall 104, about drain aperture 114.

A plug prong 162 may be provided in some embodiments of sealing system 149. As illustrated, plug prong 162 extends through at least a portion of internal volume 13. Plug prong 162 may be fixed to a portion of appliance or casing, e.g., within internal volume 13. When container 14 is in a mounted condition (see FIG. 10), plug prong 162 may extend through drain aperture 114. Plug prong 162 may include a diameter that is less than that of drain aperture 114 such that water is permitted to flow through drain aperture 114. Plug prong 162 may engage plug 150 through drain aperture 114, forcing plug 150 toward spring 152 and away from drain aperture 114. When container 14 is positioned away from plug prong 162, such as in a non-mounted condition (see FIG. 11), plug prong 162 may be disengaged from plug 150. Spring 152 may force plug 150 toward drain aperture 114, preventing undesired leaks.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance defining a plurality of mutually-orthogonal directions, the mutually-orthogonal directions including a lateral direction, a transverse direction, and a vertical direction, the stand-alone ice making appliance comprising:

an outer casing defining an internal cavity, the internal cavity including a primary opening through which the internal cavity may be accessed;

a water tank, the water tank defining a storage volume to receive water;

a pump in fluid communication with the storage volume of the water tank to actively flow water therefrom;

an ice maker, the ice maker in fluid communication with the storage volume of the water tank to receive water therefrom; and a container disposed within the internal cavity, the container including an insulated sidewall positioned across the primary opening and at least partially defining a storage volume to receive ice from the ice maker, the sidewall including a front panel and a rear panel defining a transparent insulation gap therebetween, wherein the container further comprises a base wall positioned beneath the rear panel along the vertical direction to further define the storage volume of the container, and wherein the front panel includes a bottom lip extending below the base wall along the vertical direction.

2. The appliance of claim 1, wherein the transparent insulation gap includes a sealed volume.

3. The appliance of claim 1, wherein the container further comprises a base wall positioned below a portion of the insulated sidewall to further define the storage volume of the container, and wherein the sidewall further includes an intermediate panel extending along the vertical direction from the base wall within the transparent insulation gap between the front panel and the rear panel.

4. The appliance of claim 3, wherein the intermediate panel defines a first isolated chamber within the transparent insulated gap between the front panel and the intermediate panel, and a second isolated chamber within the transparent insulation gap between the intermediate panel and the rear panel.

5. The appliance of claim 1, further comprising:

a light source positioned within the internal cavity to selectively direct light into the storage volume of the container.

6. The appliance of claim 5, wherein the light source is positioned above the storage volume of the container along the vertical direction and behind the rear panel along the transverse direction.

7. The appliance of claim 1, wherein the container further defines a drain aperture above the water tank along the vertical direction and in fluid communication between the storage volume of the container and the storage volume of the water tank, and wherein the appliance further comprises:

a plug paired to the drain aperture to selectively restrict fluid communication therethrough; and a spring attached to the plug and biased toward the drain aperture.

8. The appliance of claim 7, further comprising:

a plug prong extending within the outer casing through the drain aperture to selectively force the plug toward the spring and away from the drain aperture.

9. The appliance of claim 7, further comprising:

a support tab fixed within the storage volume of the container, wherein the spring is disposed between the support tab and the plug.

10. The appliance of claim 1, wherein the container further includes a lateral sidewall fixed to the insulated sidewall, wherein the container is selectively moveable between a first position in which container is mounted within the internal cavity, a second position in which container extends outside of the internal cavity along the transverse direction, and a third position in which the container is tilted away from the internal cavity at a predetermined angle relative to the transverse direction, and wherein the appliances further comprises:

a rail latch extending from the outer casing along the lateral direction into the internal cavity; and a guide rail fixed to the lateral sidewall and extending therefrom along the lateral direction, the guide rail defining an inclined tilt catch to engage the rail latch when the container is in the third position, wherein the inclined tilt catch is positioned rearward from the rail latch when the container is in the first position.

11. A stand-alone ice making appliance defining a plurality of mutually-orthogonal directions, the mutually-orthogonal directions including a lateral direction, a transverse direction, and a vertical direction, the stand-alone ice making appliance comprising:

an outer casing defining an internal cavity;

a rail latch extending from the outer casing into the internal cavity along the lateral direction;

a water tank, the water tank defining a storage volume to receive water;

a pump in fluid communication with the storage volume of the water tank to actively flow water therefrom;

an ice maker, the ice maker in fluid communication with the storage volume of the water tank to receive water therefrom;

a container including a base wall and a sidewall at least partially defining a storage volume to receive ice from the ice maker, the container selectively positionable in a first position in which container is mounted within the internal cavity, a second position in which container extends outside of the internal cavity along the transverse direction, and a third position in which the container is tilted away from the internal cavity at a predetermined angle relative to the transverse direction; and a guide rail fixed to the sidewall and extending therefrom in a lateral direction, the guide rail defining an inclined tilt catch to engage the rail latch when the container is in the third position.

12. The appliance of claim 11, wherein the sidewall includes a top portion that defines a sloped edge extending along the transverse direction between a front end and a rear end, and wherein the rear end is positioned below the front end along the vertical direction.

13. The appliance of claim 12, wherein the sloped edge corresponds to the inclined tilt catch.

14. The appliance of claim 11, wherein the guide rail includes a planar segment linearly extending along the transverse direction in front of the inclined tilt catch.

15. The appliance of claim 11, wherein the sidewall includes a pair of oppositely-disposed lateral walls, wherein each lateral wall includes a discrete guide rail.

16. The appliance of claim 11, wherein the sidewall includes a front panel, and wherein the front panel includes a bottom lip extending below the base wall along the vertical direction.

17. The appliance of claim 11, wherein the base wall defines a drain aperture above the water tank along the vertical direction in fluid communication between the storage volume of the container and the storage volume of the water tank.

18. The appliance of claim 17, further comprising:

a plug paired to the drain aperture to selectively restrict fluid communication therethrough; and a spring attached to the plug and biased toward the drain aperture.

19. The appliance of claim 17, further comprising:

a plug prong extending within the outer casing through the drain aperture to selectively force the plug toward the spring and away from the drain aperture.

20. The appliance of claim 17, further comprising:

a support tab fixed within the storage volume of the container, wherein the spring is disposed between the support tab and the plug.

* * * * *